US008360839B2

(12) United States Patent
Stroll

(10) Patent No.: US 8,360,839 B2
(45) Date of Patent: Jan. 29, 2013

(54) MULTI-COMBINATION CARD GAME AND GAMING APPARATUS

(75) Inventor: Michael Stroll, Libertyville, IL (US)

(73) Assignee: Stroll Enterprises LLC, Libertyville, IL (US)

( * ) Notice: Subject to any disclaimer, the term of this patent is extended or adjusted under 35 U.S.C. 154(b) by 144 days.

(21) Appl. No.: 13/051,347

(22) Filed: Mar. 18, 2011

(65) Prior Publication Data

US 2011/0230253 A1 Sep. 22, 2011

Related U.S. Application Data

(60) Provisional application No. 61/315,882, filed on Mar. 19, 2010, provisional application No. 61/370,022, filed on Aug. 2, 2010.

(51) Int. Cl.
*A63F 9/24* (2006.01)

(52) U.S. Cl. ..... 463/12; 273/292

(58) Field of Classification Search ..... 273/274, 273/292, 309; 463/12, 22
See application file for complete search history.

(56) References Cited

U.S. PATENT DOCUMENTS 5,288,082 A * 2/1994 Marquez ..... 273/292
5,294,128 A 3/1994 Marquez
5,636,842 A * 6/1997 Cabot et al. ..... 273/292
5,732,949 A * 3/1998 Josephs ..... 273/292
5,785,606 A * 7/1998 Marquez ..... 273/292
6,155,568 A 12/2000 Franklin
6,406,023 B1 * 6/2002 Rowe ..... 273/292
6,969,316 B2 * 11/2005 Jarvis et al. ..... 463/12
7,195,244 B1 * 3/2007 Feola ..... 273/292
8,197,319 B2 * 6/2012 Nicely ..... 463/12
2002/0113371 A1 8/2002 Snow
2002/0163129 A1 11/2002 Webb
2003/0006555 A1 * 1/2003 Boylan et al. ..... 273/292
2005/0040599 A1 * 2/2005 Snow ..... 273/292
2009/0102127 A1 * 4/2009 Marchesani ..... 273/292
2010/0252999 A1 * 10/2010 Lopez et al. ..... 273/292
2011/0084449 A1 * 4/2011 Poon ..... 273/292

OTHER PUBLICATIONS

International Search Report for PCT/US2011/029060 dated May 17, 2011.

* cited by examiner

*Primary Examiner* — David L Lewis
*Assistant Examiner* — Shauna-Kay Hall
(74) *Attorney, Agent, or Firm* — Seyfarth Shaw LLP

(57) ABSTRACT

Various embodiments for a game of chance are described. In an exemplary embodiment, a card game is played in which the object of the game is for each player to arrange, for example, six cards (dealt to them from a standard deck of playing cards) into three two-card combinations, with each combination having a predetermined target value of, for example, 7, 14, or 21, such that the values of the cards in each combination come as close to, but do not exceed, the target value for each respective combination.

23 Claims, 6 Drawing Sheets

MULTI-COMBINATION CARD GAME AND GAMING APPARATUS

This application claims the benefit of U.S. Provisional Application No. 61/315,882, filed Mar. 19, 2010, and U.S. Provisional Application No. 61/370,022, filed Aug. 2, 2010, the entire contents of each which are incorporated by reference.

BACKGROUND

Various wagering card games exist in which the object of the game is to receive or arrange cards such that the sum of the numbers on the front of the cards is as close to, but does not exceed, a target value. One such game is Blackjack, where players seek to get a hand that adds to twenty-one, or as close to twenty-one as possible, without exceeding that value. Play is against a dealer, who is likewise attempting to do the same. Many of these games may be played in a casino, and players may often wager on the outcomes of these games.

Many of these games have existed for hundreds of years. Accordingly, casinos and arcades desire novel games to attract players. To attract players, the games should be interesting, but also sufficiently easy so that players can quickly learn the rules of the games. An element of skill, or challenge, is also highly desirable for both the player and the casino, or "house". Players obviously relish the test of skillful play. The house looks for games that can yield a fairly consistent return statistically. Generally, a successful wagering (casino) game is one that can provide a good balance between skill, house return, and excitement.

SUMMARY

Described herein are various embodiments for a game of chance, including a wagering game suitable for a casino environment. Of course, the wagering context can extend beyond a casino-type setting, such as Internet or other electronically linked play. In an exemplary embodiment, a card game is played in which the object of the game is for each player to arrange six cards (dealt to them from one or more standard decks of playing cards) into three two-card combinations, with each combination having a predetermined target value of seven, fourteen, or twenty-one, such that the values of the cards in each combination come as close to, but do not exceed, the target value for each respective combination.

Throughout the specification, particular combinations will be described as "x-combinations," where x is the target value for that combination. Accordingly, it is not necessary that the actual value (referred to throughout the specification as simply the "value") of an x-combination actually equal x. For example, though a combination may be described as a 14-combination, thus having a target value of fourteen, the value of that combination could be less than fourteen. Further, particular combinations will be described as the "highest-valued" x-combination. This should be understood as the combination (or combinations) having the highest possible value from among all possible combinations that does not exceed the target value for that respective combination.

It should also be understood that, even though the specification describes embodiments such that players will desire to form one or more combinations with a value less than or equal to the target value for that combination, other embodiments could be implemented where players will desire to form one or more combinations with a value that is greater than or equal to the target value for that combination. Thus a "lowest-valued" x-combination could be understood as a combination having the lowest possible value that is not below x.

Though the specification describes preferred, exemplary, additional, alternative, and other embodiments, those having skill in the art will recognize that any combination of the described embodiments, and/or any feature or features within those described embodiments, may be used without departing from the scope of the claims.

Other gaming presentations besides a physical deck-of-cards, such as the use of video machines or other computer-based devices, are clearly contemplated. The number of gaming devices (e.g., cards) dealt, target values, and the number of combinations (groupings) that may be used as well without departing from the scope of the invention are also subject to much variation. That is, target values may be other than the seven, fourteen, and twenty-one values already noted above. Rather than three combinations of cards, two might be used, or four or more. However, more combinations than three have been found to slow gameplay down from what is considered to be a commercially acceptable casino rate of play. Combinations may also include more than two cards.

In an exemplary embodiment, a standard deck of cards is used. As is common practice, the face cards (i.e., cards having a king, queen, or jack on the front) have a value of ten. Similarly, in this embodiment, the ace cards have a value of one or eleven. That is, a player that is dealt an ace may choose whether the ace has a value of one or eleven. In this embodiment, if a player is dealt more than one ace, the player may choose the value of each ace independently of the chosen values of the other aces. It should be understood that the ace and/or face cards (and/or any other cards) may be assigned other values, and that the ace and face cards may be omitted from the game altogether. Players in a casino setting are most used to the common numerical values described above to a standard deck, however. Gameplay may be as straightforward as each player playing against the other.

However, in a more preferred embodiment, a participant player is designated as a dealer, and the other players play against the dealer. More particularly, the dealer may be restricted in how his or her cards may be arranged. In an embodiment using six cards arranged into the three two-card combinations, the dealer first arranges the cards to create the highest-valued 21-combination possible, even if that means that the dealer forms a 14-combination and 7-combination that has a lower value than it otherwise could have. Second, having formed the highest-valued 21-combination possible, the dealer then arranges the remaining cards to create the highest-valued 14-combination possible, even if that means that the dealer arranges a 7-combination that has a lower value than it otherwise could have. Finally, the dealer arranges the 7-combination using the two remaining cards. In this embodiment, if there are several arrangements of cards that may form the highest-valued 21-combination or 14-combination, then the dealer forms the respective combination using the highest-value card remaining Note that different restrictions on the dealer are possible as well without departing from the scope of the claims.

In some embodiments, the dealer may use at most one ace in forming the 21-combination. That is, the dealer may not use two aces in forming the 21-combination. In another embodiment, an ace is always valued at eleven (and is thus never valued at one) if the ace is used to form the dealer's 21-combination. As another possibility, if there are several arrangements of cards that may form the highest-valued 14-combination, then the dealer must choose an arrangement that does not use an ace in forming the 14-combination, if such an arrangement is available. For example, if the highest-valued 14-combination is a combination with a value of thirteen (perhaps because the dealer's remaining cards are ace, two, nine, and four), and if there are several different arrangements that can form a combination valued at thirteen (e.g., an ace and a two, and a nine and a four), then the dealer must arrange, as the 14-combination, the combination that does not include an ace. Stated another way, if a dealer forms a 14-combination that includes an ace, that is because there are no other 14-combinations possible with that particular value that do not include an ace. Other restrictions on the dealer's use of ace cards may be possible as well.

Players most preferably may be able to place a wager on each of their combinations, e.g., three wagers on two-card combinations; additionally or alternatively, one omnibus wager could be placed on the collective outcomes of the combinations, and/or players could place wagers on fewer than all of their combinations. The wagers on individual combinations may differ, if desired. In an embodiment, a player loses his or her wager for a combination if the value of that combination exceeds the target value for that combination, regardless of the dealer's outcome for that same combination. Such an outcome may be referred to as a "bust." In another embodiment, a player wins an amount based upon his or her wager if the value of that combination is closer to (and less than or equal to) the target value for that combination than the value of the dealer's combination, or if the value of that combination is less than or equal to the target value and the dealer busts for that combination. In a further embodiment, the player receives back his or her wager for a combination if the value of that combination is the same value as the dealer's combination, and if the value is less than or equal to the target value. Such an outcome may be referred to as a "push." Other possibilities for placing wagers and awarding payouts are possible as well without departing from the claims.

An alternative embodiment could use a non-standard deck of cards. Numerical values would be assigned to the cards according to some applicable indicia (e.g., numbers printed on the cards). Also disclosed herein, and forming a part of various embodiments, are numerous bonus games or bonus arrangements, which can be an added feature to the basegame play.

These as well as other aspects and advantages will become apparent to those of ordinary skill in the art by reading the following detailed description, with reference where appropriate to the accompanying drawings.

BRIEF DESCRIPTION OF THE DRAWINGS

Various exemplary embodiments are described herein with reference to the following drawings, wherein like numerals denote like entities.

DETAILED DESCRIPTION OF EMBODIMENTS OF THE INVENTION

Figure 1:
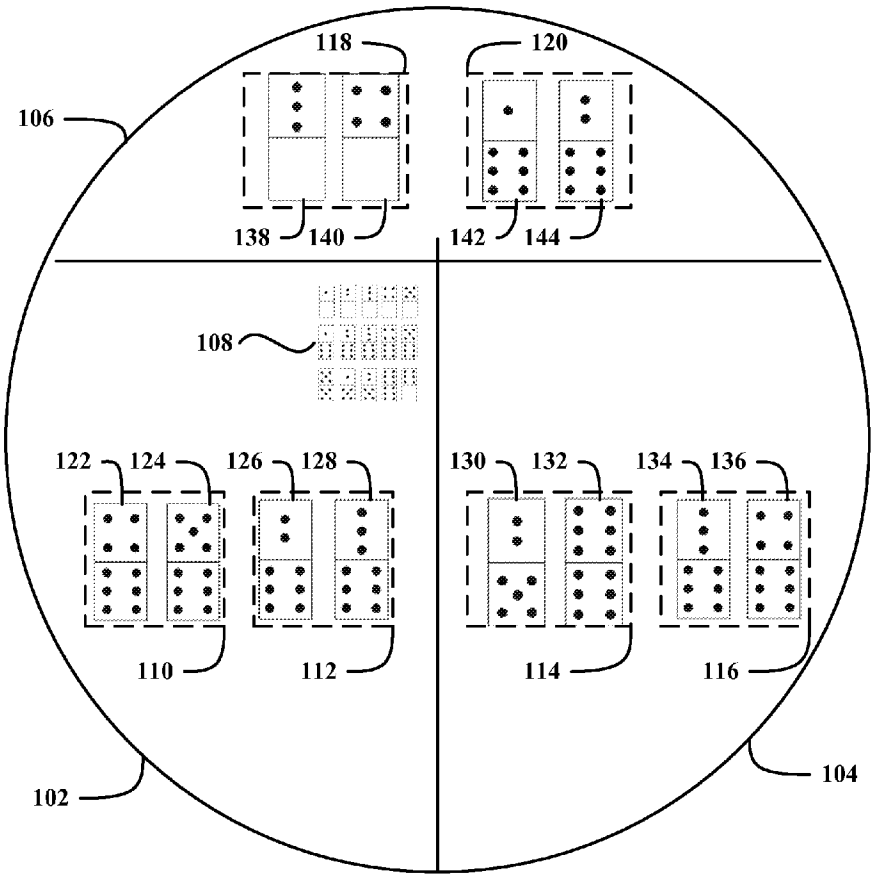
FIG. 1 is an exemplary diagram of a game setup according to the present invention.

FIG. 1 is an exemplary diagram of a game setup. It should be understood that this and other arrangements described herein are set forth only as examples. Those skilled in the art will appreciate that other arrangements and elements (e.g., gaming devices, combinations, rules, machines, interfaces, functions, orders, and groupings of functions, etc.) can be used instead or in addition, and that some elements may be omitted altogether. Further, many of the elements described herein are functional entities that may be implemented as discrete or distributed components or in conjunction with other components, and in any suitable combination and location. Various functions described herein as being performed by one or more entities may be carried out by, for example, hardware, firmware, and/or software. Various functions may be carried out by a processor executing instructions stored in memory. Alternatively, the functions may be operated manually without a computer such as by a dealer at a table. The functions may also be carried out using a manual and automated combination such as a dealer that uses physical gaming devices such as playing cards combined with an electronic system which monitors the wagering.

As shown, card game 100 includes players 102-106, a set of gaming devices 108, combinations 110-120, and gaming devices 122-144. Note than additional or fewer players, combinations, gaming devices, and/or sets of gaming devices may be present without departing from the scope of the claims. The number of players that are able to play game 100 may be limited by the number of gaming devices in the set of gaming devices 108 which are available to be dealt to players.

Players 102-106 could be, for example, human players and/or computer players (perhaps via a computer-based artificial intelligence), among other examples. Further, one or more of players 102-106 could be given an alternative designation such that a different set of rules applies to those players than applies to the other players. There may be multiple alternative designations (e.g., dealer, big blind, small blind), such that each player with an alternative designation must follow certain rules pertaining to that designation. Alternatively, players 102-106 may have no special designation, and may all play using the same rules.

Gaming devices 122-144 may be any gaming devices capable of being associated with a numeric value. As shown in FIG. 1, those gaming devices could be dominoes, but could also include, for example, dice and/or playing cards, among other examples. Some gaming devices, such as dominoes, dice, and playing cards, may have numeric values explicitly displayed on the device. Other gaming devices may not have a numeric value displayed on the device, but may instead contain one or more indicia which may be associated with a numeric value. For example, gaming devices within a particular set may have a variety of colors, and those colors could be associated with a particular numeric value (e.g., red could be one, blue could be two, green could be three, etc.). Other indicia that could be associated with a numeric value include size, shape, or weight, among numerous other possibilities. Other gaming devices or combinations thereof may be used as well without departing from the scope of the claims.

Combinations 110-120 may be any combinations of one or more gaming devices such that the combination has an associated target value. In an embodiment, each combination may be formed using a predetermined number of gaming devices (e.g., two gaming devices). In another embodiment, the number of gaming devices for a particular combination may be chosen at random, for example, by using a dice to determine that number of gaming devices for one or more combinations. Other ways of arranging combinations may be used as well.

In an embodiment, each player forms a predetermined type and number of combinations. For example, player 102 could be required to form combination 110 having a target value of 7 (a 7-combination), and a combination 112 having a target value of 14 (a 14-combination). Players 104 and 106 could also be required to form 7-combination 114 and 118, and 14-combination 116 and 120, respectively. Other quantities of combinations and different target values could be used as well. Further, the target value and number of combinations need not be predetermined, but instead could be chosen at random, for example.

The target values for each combination may be displayed on the table, gaming device, etc. on which game 100 is being played, perhaps in proximity to where the gaming devices for that combination are displayed. Those having skill in the art will recognize, however, that the target values need not be displayed; for example, the target values may not be displayed on a game table if the target values are not predetermined but are instead chosen at random or using another methodology.

The gaming devices may be dealt to players 102-106 from a set of gaming devices 108. Additionally or alternatively, the gaming devices may be dealt from a plurality of sets of gaming devices. For example, gaming devices dealt from a first set of gaming devices could be used by players in forming first combinations 110, 114, and 118, while gaming devices dealt from a second set could be used in forming second combinations 112, 116, and 120.

In an embodiment, the game may be played without the use of a gaming machine. In this embodiment, the game could be played using physical representations of the gaming devices, i.e., actual dice, dominoes, playing cards, etc. The players could play the game at one or more tables etc. in a casino, in an arcade, at home, and/or at a party, among numerous other possibilities. Other arrangements of playing the game without use of a gaming machine are possible as well without departing from the scope of the claims.

In another embodiment, the game may be played via one or more gaming machines. For example, the game could be played using a system of linked gaming machines, with each player playing the game via a respective gaming machine. The gaming machine could be a machine specifically designed for the purpose of playing the game, and/or could be a general-purpose computer, among other possibilities. The linked gaming machines could be located in proximity to each other, perhaps in a single casino or arcade (for example), and/or the gaming machines could be located at a distance from each other, perhaps among multiple rooms, buildings, cities or countries. The games machines could be linked via a network, such as a local area network or a wide area network (e.g., the Internet), among other possibilities.

In another embodiment, the game could be played using a single gaming machine. In this embodiment, the actions of players and/or dealers could be simulated by the gaming machine, allowing a player to play the game without the need for additional live players. Those having skill in the art will recognize that other ways of utilizing one or more gaming machines may exist without departing from the scope of the claims.

Figure 2:
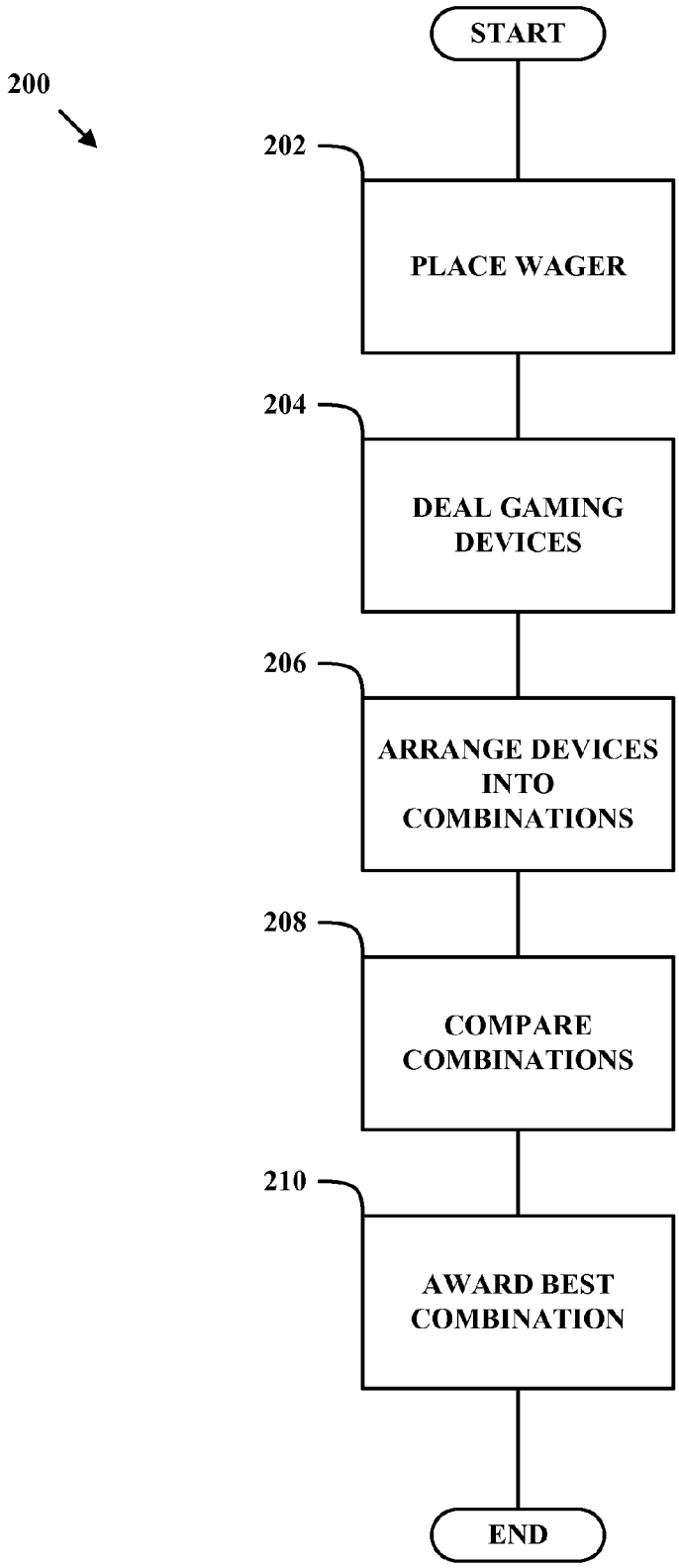
FIG. 2 is a flowchart of an exemplary method according to the present invention.

FIG. 2 is a flowchart of an exemplary method. As shown in FIG. 2, method 200 begins at step 202 with each player placing a wager. The wager could be on individual combinations, or on a plurality of combinations, among other possibilities. Further, the wager could be placed on the wagering player's own combinations, and/or could be placed on other player's combination, among other examples. The wager could be in the form of money, in the form of another wagering device such as casino chips or plaques, or in the form of non-monetary points or another arbitrary denomination. The wager could be the same among combinations, or could differ among combinations. Further, the step of placing a wager may be omitted altogether. Those having skill in the art will recognize that other methods and arrangements for placing a wager are possible without departing from the scope of the claims.

At step 204, players 102-106 are dealt one or more gaming devices 122-144 from the set of gaming devices 108. The gaming devices could be dealt "face up," such that the associated numeric values of the gaming devices are visible to other players, or "face down," such that the associated numeric values are not visible. Some gaming devices may be incapable of being dealt face down; in this case, those gaming devices may be dealt face up (i.e., immediately visible). The gaming devices could be visible to some players (such as the player receiving the dealt playing device) while not visible to other players. Further, even though gaming devices are initially dealt face up or face down, it's possible that, during play of the game, the visibility of the gaming devices change. Other possibilities for dealing gaming devices 122-144 exist as well.

Method 200 continues at step 206 with players 102-106 arranging their dealt gaming devices into a plurality of combinations 110-120. A skilled player will attempt to arrange the gaming devices such that the sum of each combination is as close as possible to the target value for that combination, but such that the sum does not exceed the target value. For example, player 102 should attempt to form 7-combination 110 such that the sum of that combination is as close to seven as possible, but without exceeding seven. Similarly, player 102 should attempt to form 14-combination 112 such that the sum of that combination is as close to fourteen as possible, but without exceeding fourteen.

At step 208, players 102-106 compare combinations having a first target value to determine which player has the highest-valued combination for that target value (without exceeding that target value). In an embodiment, a player wins a combination if the sum of the numeric values for a combination is at or below a target value for that combination, but is above the sum for that combination of any player who is also at or below that target value. For example, players 102-106 may determine who has the highest-valued 7-combination by comparing combinations 110, 114, and 118 to determine which combination is closest to but does not exceed the target value of 7. In another embodiment, a player compares his or her combinations with only those combinations of the dealer, and does not compare combinations formed by other players. Other methods of comparing combinations may be used as well.

At step 210, the player having the highest-valued combination for a particular target value is provided an award. The award could be in the form of points, which could be accumulated as multiple games are played. Additionally or alternatively, the award could be in the form of a payout if the player had placed a wager on that combination. Further, multiple combinations could be awarded; for example, the two highest-valued combinations could receive an award. Those having skill in the art will recognize that other forms of awards may be provided without departing from the scope of the claims.

Figure 3:
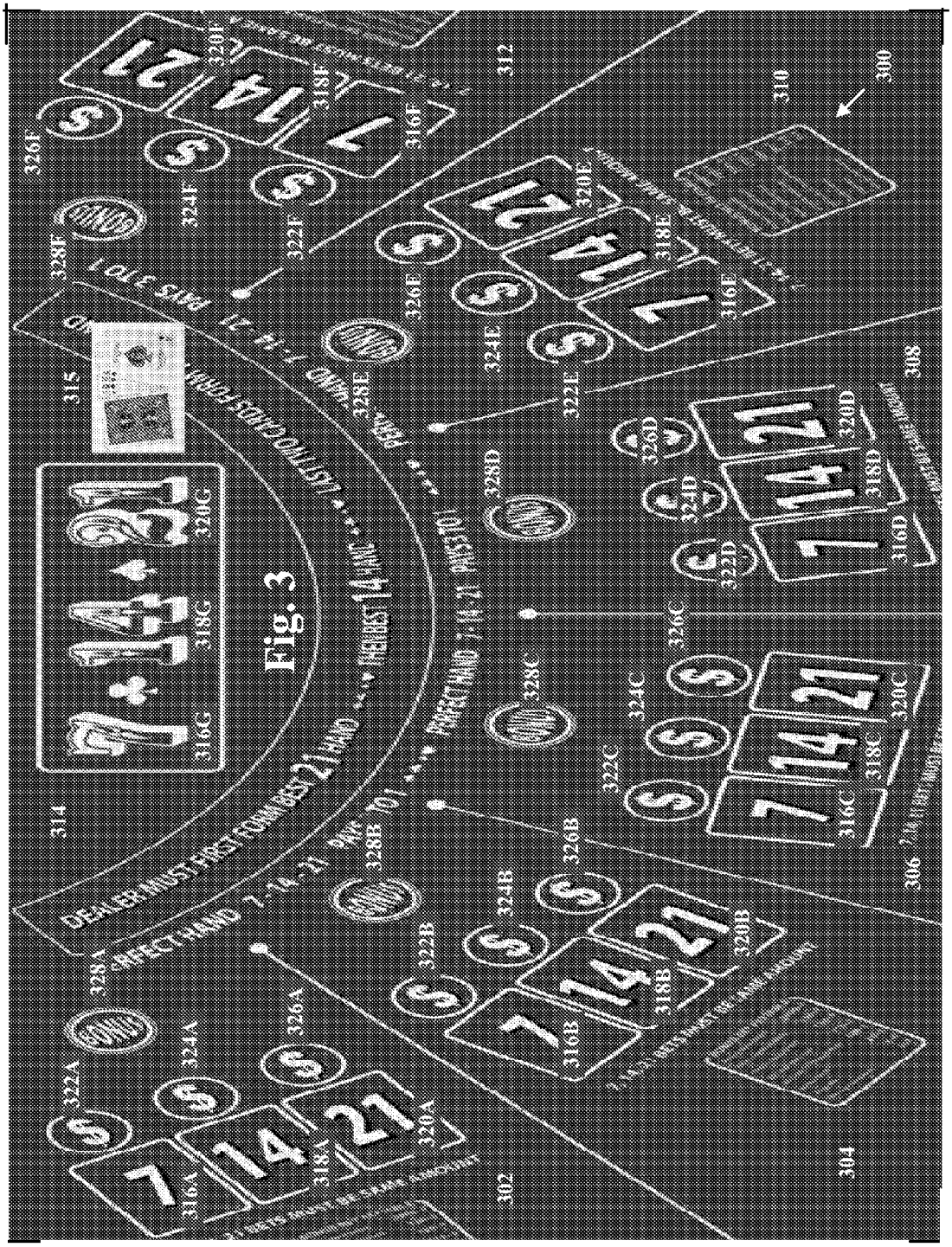
FIG. 3 is an exemplary diagram of a card game setup according to the present invention.

An exemplary embodiment of a wagering game is described with reference to FIGS. 3 and 4. FIG. 3 is a diagram of a card game setup of the exemplary embodiment. As shown, game 300 includes players 302-314 (of which player 314 is the dealer), a set of gaming devices 315, combinations 316A-G, 318A-G, and 320A-G, and wager 322-F, 324A-F, 326A-F, and 328A-F.

In game 300, the set of gaming devices 315 is standard deck of fifty-two playing cards, and the gaming devices are individual playing cards. The associated numeric value of the face cards is 10, and the value of aces is one or eleven. In other embodiments, the face cards and/or the aces (among other cards) may be assigned different numeric values, as described above. Note that in alternative embodiments, the set of gaming devices 315 may comprise a different combination of playing cards, and that additional sets of gaming devices may be present.

In game 300, each combination consists of two playing cards. Combinations 316A-G have a target value of 7, combinations 318A-G have target value of 14, and combinations 320A-G have a target value of 21. As explained above, other embodiments may use a different number of combinations, having a different number of gaming devices and a different target value.

Figure 4:
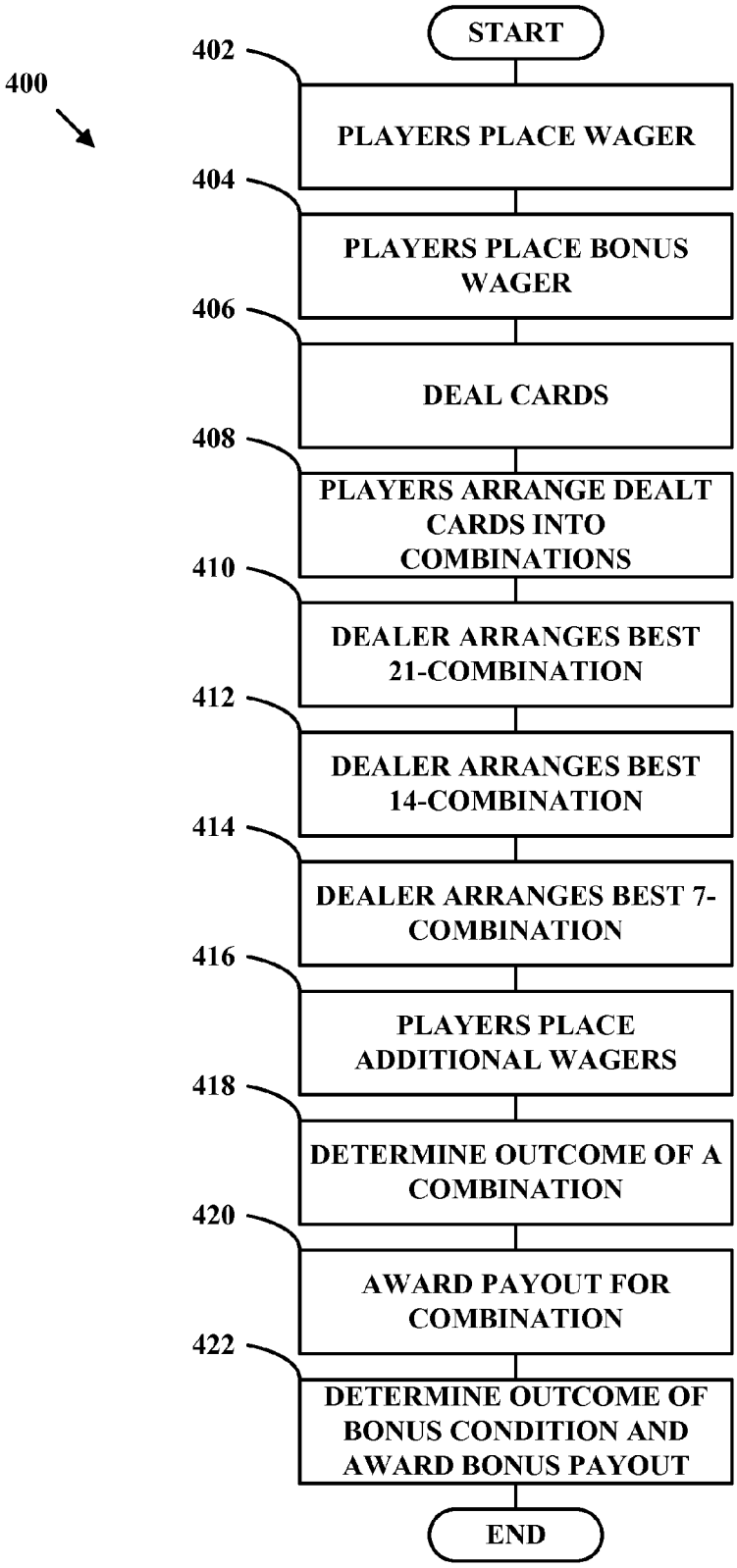
FIG. 4 is a flowchart of an exemplary method according to the present invention.

FIG. 4 is a flowchart of an exemplary method of playing game 300. As shown in FIG. 4, method 400 begins at step 402 with players 302-312 (but not dealer 314) placing a wager on each combination that the player is to form during play of game 300. For example, player 302 places wager 322A, 324A, and 326A on combinations 316A, 318A, and 320A, respectively. In the present embodiment, each wager is the same; for example, wagers 316A, 318A, and 320A will be the same. In alternative embodiments, different wages may be placed on each combination that the player is to form during play of game 300, and/or wagers may be placed on fewer than all combinations. Note that additional or alternative methods for placing a wager may be possible as well without departing from the scope of the claims. For example, dealer 314 could be allowed to place one or more wagers, or step 402 may be eliminated altogether.

At step 404, players 302-312 (but again not dealer 314) may place a bonus wager. The bonus wager may be an optional wager that provides an additional payout at the end (or other stage) of the game, depending on whether certain conditions are met. In an alternative embodiment, a player may place a plurality of bonus wagers, and may perhaps wager on different outcomes or conditions. Other ways of placing a bonus wager are possible as well, such as allowing dealer 314 to also place a bonus wager.

At step 406, players 302-314 (including the dealer) are dealt six cards by dealer 314. In the present embodiment, the cards are dealt face down so that players will not arrange their combinations based upon how other players (such as the dealer) are arranging their combinations. However, some or all of the cards could be dealt face up in an alternative embodiment. For example, the dealer's cards could be dealt face down while the players' cards are dealt face up, among numerous other possibilities. Further, a subset of cards could be dealt at step 406, while additional cards could be dealt at a different stage of the game. Fewer (or more) than six cards may be dealt at step 314 without departing from the scope of the claims.

At step 408, players 302-312 arrange their respective six cards to form their respective 7-combination, 14-combination, and 21-combination. Because of how payouts are rewarded, each player should attempt to arrange the cards such that the sum of each combination is a close to the target value for each respective combination, without exceeding the target value of the combination. As described above, different target values may also be used.

At step 410, dealer 314 creates the highest-valued 21-combination 320G from among the six cards dealt to the dealer. That is, the dealer forms a 21-combination 320G using the two cards that will allow the 21-combination to be as close to the target value of 21, but without exceeding 21. In the present embodiment, dealer 314 may use at most one ace card in forming the 21-combination, and that one ace is always valued at eleven, rather than one. In alternative embodiments, the dealer may be able to use more than one ace card, and that the ace card could be valued at eleven or one, among numerous other possibilities. In another exemplary embodiment, if there are several arrangements of cards that may form the highest-valued 21-combination 320G (or possibly any other combination or set of combinations), then dealer 314 must choose the highest value card available when forming that combination.

At step 412, dealer 314 creates the highest-valued 14-combination 318G possible from among the remaining four cards. If it is not possible for the dealer to form the highest-valued 14-combination without busting, then the 7-combination will also bust. In the present embodiment, if there are multiple arrangements of cards that may form highest-valued possible 14-combination, then dealer 314 must choose an arrangement that does not use an ace in forming 14-combination 318G, if such an arrangement is possible. Stated another way, if the highest-valued 14-combination is a combination with a value of y, and if there are multiple different arrangements of the 14-combination that can form a combination valued at y (e.g., an ace and a two, and a nine and a four), then the dealer must arrange, as the 14-combination, the combination that does not include an ace. Table 1 lists examples of how 14-combinations must be arranged in this particular embodiment as a result of this rule if one of the dealer's possible 14-combinations includes an ace.

TABLE 1

| Dealer's Four Remaining Cards After Arranging 21-Combination | Dealer Must Arrange for the 14-Combination | Dealer Must Arrange for the 7-Combination |
|---|---|---|
| {A,A,A} and [{2} or {3}] | {A,2} or {A,3} | {A,A} |
| {A,A} and [{8,4} or {7,5} or {6,6}] | {8,4} or {7,5} or {6,6} | {A,A} |
| {A,3} and [{10,4} or {9,5} {8,6} or {7,7}] | {10,4} or {9,5} or {8,6} or {7,7} | {A,3} |
| {A,2} and [{9,4} or {8,5} or {7,6}] | {9,4} or {8,5} or {7,6} | {A,2} |
| {A,2,2,x} where x ≠ 3 | {A,2} | {2,x} |
| {A,3,3,y} | {A,3} | {3,y} |

Note that several 14-combinations in Table 1 include an ace. This is permissible because, if the dealer forms that particular 14-combination, then there are no other possible combinations of that same value that do not have an ace. Note that different and/or additional (or no) restrictions on the dealer's use of ace cards (or any other cards) may be possible as well without departing from the scope of the claims.

Again, in an alternative embodiment, if there are multiple arrangements of cards that may form the highest-valued 14-combination 318G, then dealer 314 must choose the highest value card available when forming that combination (though an ace may be valued as a one if it will prevent the dealer from busting). Further, if dealer 314 is unable to form 14-combination 318G in the present embodiment without exceeding the target value (i.e., without the 14-combination resulting in a bust), then the dealer must choose the two highest-value cards remaining in forming the 14-combination (or any other combination).

At step 414, dealer 314 creates 7-combination 316G from among the remaining cards dealt to the dealer.

In the present embodiment, steps 410-414 are carried out after step 408 is completed. In an alternative embodiment, steps 410-414 could be carried out simultaneously with step 408, such that the dealer is arranging his or her combinations at the same time that the other players are arranging their combinations. In another alternative embodiment, steps 410-414 could be carried out before step 408. Those having skill in the art will recognize that other arrangements of steps 408-414 are possible as well without departing from the scope of the claims. For example, the dealer could form the 7-combination or 14-combination prior to forming the 21-combination.

At step 416, players 302-312, having arranged their cards into combinations, may be given an additional opportunity to place a wager. In an embodiment, this additional wager may have a lower payout than the wager placed at step 404 because the player can now tailor the bet to his or her formed combinations, and thus to the likelihood that the player will win that combination. As another possibility, the players could be given an additional opportunity to place a wager after arranging their combinations and before the dealer shows his or her combinations (i.e., turns his or her combinations face up). In another embodiment, the payouts for the additional wager could be equal to or greater than the payouts for wagers placed at step 404, and/or step 416 may be eliminated altogether, among various other possibilities.

At step 418, dealer 314 determines the outcome of one or more combinations. In the present embodiment, the dealer and/or players turn the cards face up. In the present embodiment, the dealer first compares all of the combinations of player 302 to all of the combinations of dealer 314. In an alternative embodiment, the dealer could compare fewer than all of the combinations formed by player 302 before comparing the combinations of players 304-312. For example, dealer 314 could compare all of the 7-combinations among players 302-312 before comparing any of the 14-combinations or 21-combinations of the players. Multiple other possibilities for comparing combinations are possible as well without departing from the scope of the claims.

In the present embodiment, dealer 314 first compares 7-combination 316A of player 302 to 7-combination 316G of the dealer. If 7-combination 316A of player 302 results in a bust (that is, the value of the 7-combination exceeds the target value of seven), then a losing condition results for 7-combination 316A of player 302. If the value of 7-combination 316A of player 302 is at or below the target value of 7, and either (i) the value of 7-combination 316A of player 302 exceeds the value of 7-combination 316G of dealer 314, or (ii) the value of 7-combination 316G of dealer 314 results in a bust, then a winning condition results for 7-combination 316A of player 302. If the value of 7-combination 316A of player 302 is at or below the target value of 7 and is equal to the value of 7-combination 316G of dealer 314, then a "push" condition results for 7-combination 316A of player 302. Note that other outcome conditions for other values are possible as well without departing from the scope of the claims.

In the present embodiment, having compared the 7-combination for player 302, the dealer may then compare the 14-combination of player 302, and finally the 21-combination of player 302. Note that other arrangements for comparing combinations may be used as well. For example, dealer 302 could first compare the 21-combination before comparing the 14-combination or the 7-combination, among other possibilities.

In the present embodiment, a winning condition automatically results for 7-combination 316A, 14-combination 318A, and 21-combination 320A of player 302 if the values of these combinations are seven, fourteen, and twenty-one, respectively. Such a result by player 302 is called a "perfect hand." These winning conditions result even if the comparison of the value of that combination of player 302 to the value of the dealer's combination having the same target value would have resulted in a "push."

In an additional embodiment, if dealer makes perfect hand, all players are deemed to have tied (pushed) the dealer on the 7-, 14- and 21-combinations, and therefore neither the dealer nor the players win. Those having skill in the art will recognize that other arrangements of dealer and/or player cards may create other outcome conditions without departing from the scope of the claims.

The same methodology described in step 418 with respect to player 302 may also be used also to compare the combinations of players 304-312.

At step 420, dealer 314 awards one or more payouts based upon the comparison at step 418 and based upon the amount of the wagers placed at step 402. The payout could be in the form of chips, credits, points, and/or currency, among numerous other possibilities. The payout for a winning combination could be, for example, a multiple of the wager (e.g., 1.5), and the payout for a "push" combination could be a different multiple of the wager (e.g., 1.0 or 0). Further, the multiplier may be higher (e.g., 3) if a player has a perfect hand. The multiplier could also be based on the target value of the combination on which the wager was placed. For example, a winning condition for a 7-combination may have a higher multiplier than a winning condition for a 14-combination or 21-combination. Other methodologies of awarding a payout may be used as well.

At step 422, dealer 314 determines the outcome of a bonus condition for players 302-312, and awards a payout if one or more of the bonus conditions are satisfied. A list of exemplary bonus conditions and exemplary payout multipliers is presented in Table 3.

TABLE 3

| |
|---|
| Win 7-combination and 14-combination, or win 7-combination and 21-combination (1x) |
| Win 14-combination and 21-combination (1x) |
| Win any two of three combinations (lx) |
| Win all three combinations (5x) |
| Perfect hand (20x) |
| All cards are any combination of 10s and face cards (100x) |
| All cards are same suit (115x) |
| Perfect hand with all cards of the same color (i.e., all black or all red) (150x) |
| Perfect hand with cards of each combination of the same suit (though not all combinations are the same suit) (150x) |
| Perfect hand with all cards of same suit (2000x) |

Those having skill in the art will recognize that different and/or additional bonus conditions may be present as well, without departing from the scope of the claims.

Those of ordinary skill in the art will be able to analyze the maximum return of the game based on the rules of the game (i.e., number of gaming devices dealt, the number of combinations, the number of gaming devices per combination, target values, dealer rules, etc.).

For any six cards that a player is dealt, there are $$\binom{6}{2}\binom{4}{2} = 15 \times 6 = 90$$

possible ways to form those cards into three two-card combinations, where $$\binom{6}{2}$$

is the number of possible combinations that can be made out of six cards selected two at a time and is referred to as "6 choose 2." This is because there are fifteen ways to select two cards to form the first two-card combination, and six ways to form the second two-card combination from the remaining four cards (leaving no choice for the third two-card combination).

The expected return of the game is determined by evaluating the best play for each of the $$\binom{52}{6} = 20{,}358{,}520$$

possible player sets of dealt cards. A computer program written in MATLAB, the C programming language or any appropriate programming language iteratively steps through each of the 20,358,520 possible 6-card player sets of dealt cards. There are ninety different ways to arrange each player set of dealt cards. The program needs to determine the best arrangement (out of ninety) against the $$\binom{42}{6} = 9{,}366{,}819$$

possible dealers sets of dealt cards for that particular player set of dealt cards (each arranged in combinations one way according to the dealer hand rules).

Using two units for each win and one unit for each tie, the total amount won against the 9,366,819 possible dealer sets of dealt cards is computed for each of the ninety ways to arrange the player set of dealt cards. The arrangement that yields the highest total is the optimal way to play that player set of dealt cards. The evaluation of a player set of dealt cards is concluded by logging each of the 9,366,819 results for each possible dealer set of dealt cards against this arrangement in the "Combination Count" column of Table 4. That is, each of the possible 9,366,819 dealer set of dealt cards results in a win, push or loss in each of the 7-, 14-, and 21-combinations. Thus for each player set of dealt cards, a combination of wins, pushes and losses totaling 9,366,819 will be added to the 7-combination counters based on how the 7-combination in the best arrangement compares to the 7-combination in each possible dealer set of dealt cards. The 14-combination and 21-combination counters are updated in a similar fashion for each player set of dealt cards. Thus each two-card combination will have a total of 9,366,819 values placed in Table 4 for each of the 20,258,520 possible player set of dealt cards for a total of 9,366,819×20,258,520=190,694,571,947,880 entries.

In Table 4 the probability column shows the probability of a win, loss or push for each combination type and is computed by dividing the combination count by the 190+ trillion total combination count.

The Pay column shows the number of betting units returned for the specified result (per betting unit wagered).

The EV (Expected Value) column shows the return for each unit bet by multiplying the probability and Pay values for each row. In Table 4 it can be seen that with optimal play the 21-combination returns much less than the amount wagered while the 7-combination returns more than the amount wagered. Since the dealer's fixed strategy optimizes the 21-combination first, it follows that with optimal play the player strategy (of playing the best of the 90 combinations based on the above evaluation) capitalizes on the 7-combination against the dealer's leftover cards.

The overall return of the game is arrived at by adding the EV values for the 7-, 14-, and 21-combinations and dividing by the three betting units wagered resulting in 0.972050 or 97.2050%.

In another embodiment of the game, the same rules are used; however if the player is able to arrange a hand which exactly hits the three target values of seven, fourteen and twenty-one, then a bonus is paid regardless of the values contained in the dealer's hand. In the embodiment analyzed here each wager is paid at three-to-one and the game ends without comparing to the dealer cards.

Table 5 shows how a similar process is used to compute the return of a game with the same rules and offering a three-to-one payout for a perfect hand. As each player set of dealt cards is analyzed, it is checked whether any of the ninety possible play combinations result in a perfect seven, fourteen, and twenty-one. Each time this occurs (just under 0.7%) the Combination Count column corresponding to Perfect Hand in Table 5 is incremented by 9,366,819 (indicating the perfect hand is paid for any possible dealer set of dealt cards). There is no entry for win/push/loss in the 7-, 14-, and 21-combination areas for each perfect hand; thus the number of possible combinations in each of these sections is reduced by about 0.7%.

The Expected Value component for the perfect hand line is computed by multiplying the probability by the pay of twelve betting units (three units paid in addition to returning the bet for a total of four betting units for each of the three combinations). To change the pay value for a perfect hand (to four-to-one, for example) this pay value may be changed without re-computing the table. This is because all of the perfect hands have already been removed from the strategy section of Table 5.

Finally, the return (EV) for this embodiment with the bonus payout of three-to-one for a perfect hand is computed by adding up the EV components for each of the 7-, 14-, and 21-combinations and adding in the EV component for the Perfect hand and then dividing the sum of all these components by the three betting units resulting in 0.987645 or 98.7645%. This is the highest long-term expected return for the game with this paytable and rules. It can only be achieved by the player consistently playing the perfect strategy of arranging the cards as chosen by the analysis of the ninety possible ways to arrange each hand. In operation, just as in Video Poker and Blackjack, the return will be lower due to inaccurate play by the player resulting in a higher hold percentage for the operator of the game.

TABLE 4

| | Outcome | Combination Count | Probability | Pay | EV |
|---|---|---|---|---|---|
| 7-combination | Player wins: | 99,578,667,022,986 | .522189 | 2 | 1.0443786 |
| | Player pushes: | 7,693,470,000,462 | .040344 | 1 | 0.0403445 |
| | Player loses: | 83,422,434,924,432 | .437466 | 0 | 0 |
| | Total: | 190,694,571,947,880 | 1 | | 1.084723 |
| 14-combination | Player wins: | 76,079,880,450,194 | .398962 | 2 | 0.7979239 |
| | Player pushes: | 44,649,993,843,044 | .234144 | 1 | 0.234144 |
| | Player loses: | 69,964,697,654,642 | .366894 | 0 | 0 |
| | Total: | 190,694,571,947,880 | 1 | | 1.032068 |
| 21-combination | Player wins: | 52,754,311,235,687 | .276643 | 2 | 0.5532859 |
| | Player pushes: | 46,924,995,347,885 | .246074 | 1 | 0.2460741 |
| | Player loses: | 91,015,265,364,308 | .477283 | 0 | 0 |
| | Total: | 190,694,571,947,880 | 1 | | 0.799360 |
| | | | | Total: | 0.972050 |

TABLE 5

| | Outcome | Combination Count | Probability | Pay | EV |
|---|---|---|---|---|---|
| 7-combination | Player wins: | 98,351,547,179,402 | 0.515754 | 2 | 1.0315086 |
| | Player pushes: | 7,594,548,011,854 | 0.039826 | 1 | 0.0398257 |
| | Player loses: | 83,422,434,924,432 | 0.437466 | 0 | 0 |
| | Total: | 189,368,530,115,688 | 0.99305 | | 1.07133 |
| 14-combination | Player wins: | 75,239,808,955,794 | 0.394557 | 2 | 0.7891133 |
| | Player pushes: | 44,164,023,505,252 | 0.231596 | 1 | 0.2315956 |
| | Player loses: | 69,964,697,654,642 | 0.366894 | 0 | 0 |
| | Total: | 189,368,530,115,688 | 0.99305 | | 1.02071 |
| 21-combination | Player wins: | 51,808,306,547,303 | 0.271682 | 2 | 0.5433643 |
| | Player pushes: | 46,544,958,204,077 | 0.244081 | 1 | 0.2440812 |
| | Player loses: | 91,015,265,364,308 | 0.477283 | 0 | 0 |
| | Total: | 189,368,530,115,688 | 0.99305 | | 0.787445 |
| | Perfect Hand: | 1,326,041,832,192 | 0.006954 | | 0.083445 |
| | Total: | 190,694,571,947,880 | 1 | | 0.987645 |

As described above, there are various different bonus bets where a separate wager is placed and paid according to its own paytable. It is preferred that a wager is required on the base game to allow placement of a bonus bet wager; however, a bonus bet wager by itself could be allowed without departing from the scope of the claims.

The exemplary bonus bet being analyzed provides payouts for six pay categories as shown in Table 6.

TABLE 6

| | |
|---|---|
| Perfect Hand (7, 14 and 21) all cards the same suit: | 2000 to 1 |
| Perfect Hand (7, 14, and 21) all cards the same color: | 75 to 1 |
| All cards same suit (non-perfect hand): | 35 to 1 |
| Perfect Hand (7, 14, and 21) different suits: | 15 to 1 |
| Win on all 3 hands: | 8 to 1 |
| Win on 2 out of 3 hands: | 1 to 1 |

The bonus bet is only paid for the highest (largest win) in Table 6, thus, for example if the player has all cards the same suit then the pay for the bonus bet will be thirty-five-to-one regardless of how many of the three two-card combinations are won by the player.

The analysis of a particular bonus bet is done using a very similar procedure as described for the base game above. For each of the 20,258,520 possible player set of dealt cards, each of the 9,366,819 possible dealer set of dealt cards (of the remaining 46 cards) is examined and scored using the bonus bet paytable. As in the base game, for each player set of dealt cards, each of the ninety possible ways to set the dealt cards are scored, and for each player set of dealt cards the result against the 9,366,819 dealer set of dealt cards are added to the combination counts in Table 7 based on the results against the best of the ninety ways to arrange the particular player set of dealt cards. Because only the highest winner is paid from the awards in Table 6 each combination will be uniquely assigned to a row of Table 7 thus the total combination count in this table is the same 190+ trillion total of $$\binom{52}{6}\binom{46}{6}.$$

The probability is computed in the same manner as in Table 4 by dividing the combination count by the 190+trillion total. The pay is the number of betting units returned to the player for each betting unit wagered on this bonus bet. A one-to-one payout pays a total of two when it includes the original wager. Likewise a 2000 to 1 bet pays 2001 when it includes the original wager. The Expected Value (EV) column is computed by multiplying the probability by the pay value. By adding up the EV of all possible results we see that when this bonus bet is played with a strategy to maximize the return on this wager that the expected return is 0.988026 or 98.8026%.

TABLE 7

| | Combination Count | Probability | Pay | EV |
|---|---|---|---|---|
| No bonus: | 123,802,733,029,166 | 0.64922002 | 0 | 0 |
| Win any 2 hands: | 61,135,114,016,006 | 0.32059179 | 2 | 0.641184 |
| Win all 3 hands: | 4,367,063,635,868 | 0.02290083 | 9 | 0.206107 |
| Perfect hand: | 1,292,171,414,688 | 0.00677613 | 16 | 0.108418 |
| Fully suited hand: | 63,619,434,648 | 0.00033362 | 36 | 0.012010 |
| Same color perfect hand: | 33,196,006,536 | 0.00017408 | 76 | 0.013230 |
| Same suit perfect hand: | 674,410,968 | 0.00000354 | 2001 | 0.007077 |
| | 190,694,571,947,880 | 1.0000 | | 0.988026 |

While Table 7 shows the return of this bonus bet achieved by selecting the optimal card combination for each possible set of dealt cards, when combined with the base game represented by Table 4 or 5 the attempt to optimize the strategy for the base game will change the results for the bonus game. Table 8 shows how the EV calculation for this bonus game is affected if, during the analysis of each player set of dealt cards, the combination providing the best results for the base game of Table 5 is selected. In this case, for each possible player set of dealt cards, after selecting the combination that gives the highest return for the base game, this combination is used against the 9,366,819 possible dealer set of dealt cards and added to the combination count for the bonus bet award for that combination. As expected, shifting from the optimal bonus game strategy to the optimal base game strategy, the return of the bonus game decreases. In this case it drops from 98.8026% to 97.6592%

TABLE 8

| | Combination Count | Probability | Pay | EV |
|---|---|---|---|---|
| No bonus: | 124,803,921,699,186 | 0.65447024 | 0 | 0 |
| Win any 2 hands: | 60,159,367,184,130 | 0.31547498 | 2 | 0.630950 |
| Win all 3 hands: | 4,341,621,797,724 | 0.02276741 | 9 | 0.204907 |
| Perfect hand: | 1,292,171,414,688 | 0.00677613 | 16 | 0.108418 |
| Fully suited hand: | 63,619,434,648 | 0.00033362 | 36 | 0.012010 |
| Same color perfect hand: | 33,196,006,536 | 0.00017408 | 76 | 0.013230 |
| Same suit perfect hand: | 674,410,968 | 0.00000354 | 2001 | 0.007077 |
| | 190,694,571,947,880 | 1.0000 | | 0.976592 |

In a similar manner, Table 9 shows what happens to the return of the base game when perfect bonus game strategy is used. As expected, the EV of the base game when using a strategy optimized for the bonus game goes down. In this case from 98.7645% to 96.9091%.

TABLE 9

| | Outcome | Combination Count | Probability | Pay | EV |
|---|---|---|---|---|---|
| 7-combination | Player wins: | 92,907,706,095,832 | 0.4872069 | 2 | 0.974414 |
| | Player pushes: | 7,143,172,515,660 | 0.0374587 | 1 | 0.037459 |
| | Player loses: | 89,317,651,504,196 | 0.4683807 | 0 | 0.000000 |
| | Total: | 189,368,530,115,688 | 0.9930463 | | 1.011872 |
| 14-combination | Player wins: | 76,489,796,785,694 | 0.4011116 | 2 | 0.802223 |
| | Player pushes: | 45,714,728,966,234 | 0.2397275 | 1 | 0.239727 |
| | Player loses: | 67,164,004,363,760 | 0.3522072 | 0 | 0.000000 |
| | Total: | 189,368,530,115,688 | 0.9930463 | | 1.041951 |
| 21-combination | Player wins: | 50,851,134,782,637 | 0.2666627 | 2 | 0.533325 |
| | Player pushes: | 45,133,452,885,255 | 0.2366793 | 1 | 0.236679 |
| | Player loses: | 93,383,942,447,796 | 0.4897043 | 0 | 0.000000 |
| | Total: | 189,368,530,115,688 | 0.9930463 | | 0.770005 |
| | Perfect Hand: | 1,326,041,832,192 | 0.0069537 | 12 | 0.083445 |
| | Total: | 190,694,571,947,880 | 1.0000000 | | 0.969091 |

When the base game and bonus game are combined there are a number of sets of dealt cards that have different optimal combinations out of the ninety possible choices. Using the information from tables 5 through 9, some conclusions can be made about which strategy would work better overall.

Table 10 shows the returns for this base game and bonus game using the two strategies discussed above. If the wager on the bonus bet is the same amount as the total wagered on all base game bets then a return of 98.21% would be achieved by playing the optimal base game strategy while a return of 97.86% would be achieved by playing the optimal bonus game strategy.

TABLE 10

| | Optimize Base Return | Optimize Bonus Return |
|---|---|---|
| Base Game EV | 98.764454% | 96.909092% |
| Bonus Game EV | 97.659185% | 98.802621% |
| | 98.211820% | 97.855856% |

In practice, it is likely that the bonus bet will be smaller than the total wagered on the base game. A typical application in a casino requires a $5.00 minimum bet on each base game hand. Very common betting combinations are shown in Table 11.

TABLE 11

| Base Game Bet Per Hand | Bonus Bet |
|---|---|
| $5.00 | $1.00 |
| $5.00 | $5.00 |
| $25.00 | $5.00 |

Table 12 expands Table 10 to include the betting ratios shown in Table 11. As expected, as the proportion bet on the base game increases, the return for using the optimal base game strategy increases.

TABLE 12

| | Optimize Base Return | Optimize Bonus Return |
|---|---|---|
| Base Game EV | 98.764454% | 96.909092% |
| Bonus Game EV | 97.659185% | 98.802621% |
| Bonus = Base × 3 | 98.211820% | 97.855856% |
| Bonus = Base/3 | 98.488137% | 97.382474% |
| Bonus = Base/15 | 98.695375% | 97.027437% |

The maximum return for a given ratio of base game and bonus game wagers involves an arrangement strategy of dealt cards that doesn't exactly match either the base or bonus game strategy. It is computed by using a similar computer program to iterate through each of the 20,258,520 player set of dealt cards as has been done in previous examples. For each player set of dealt cards, for each of the ninety ways to play the dealt cards, a payout total is computed which is the sum of payouts (base and bonus) for all 9,366,819 possible dealer set of dealt cards played against that particular combination. For the combination yielding the highest payout total (of the ninety combinations tried for a given player set of dealt cards) the combination count totals are increased (9,366,819 different possible dealer set of dealt cards added for each of the three base game hands and 9,366,819 possible dealer set of dealt cards added across the seven possible bonus game results).

Tables 13 and 14 show the calculations for the base and bonus games when the bonus bet is one third the base game bet (same amount on each hand and bonus game). Table 15 shows the computation of the weighted combination of 3 units on the base game with 1 unit on the bonus game based on the results in Tables 13 and 14. The resulting 98.56% is a little better than the 98.49% when the optimal base game strategy is used with this betting ratio.

TABLE 13

| | Outcome | Combination Counts | Probability | Pay | EV |
|---|---|---|---|---|---|
| 7-combination | Player wins: | 96,918,274,223,962 | 0.5082382 | 2 | 1.016476 |
| | Player pushes: | 7,509,739,127,470 | 0.0393810 | 1 | 0.039381 |
| | Player loses: | 84,940,516,764,256 | 0.4454270 | 0 | 0.000000 |
| | Total: | 189,368,530,115,688 | 0.9930463 | | 1.055857 |

TABLE 13-continued

| | Outcome | Combination Counts | Probability | Pay | EV |
|---|---|---|---|---|---|
| 14-combination | Player wins: | 76,506,226,260,128 | 0.4011977 | 2 | 0.802395 |
| | Player pushes: | 45,020,617,506,240 | 0.2360876 | 1 | 0.236088 |
| | Player loses: | 67,841,686,349,320 | 0.3557610 | 0 | 0.000000 |
| | Total: | 189,368,530,115,688 | 0.9930463 | | 1.038483 |
| 21-combination | Player wins: | 52,122,970,424,023 | 0.2733322 | 2 | 0.546664 |
| | Player pushes: | 45,154,902,147,793 | 0.2367918 | 1 | 0.236792 |
| | Player loses: | 92,090,657,543,872 | 0.4829223 | 0 | 0.000000 |
| | Total: | 189,368,530,115,688 | 0.9930463 | | 0.783456 |
| | Perfect Hand: | 1,326,041,832,192 | 0.0069537 | 12 | 0.083445 |
| | Total: | 190,694,571,947,880 | 1.0000000 | | 0.987081 |

TABLE 14

| | Combination Counts | Probability | Pay | EV |
|---|---|---|---|---|
| No bonus: | 124,412,759,916,874 | 0.65241899 | 0 | 0 |
| Win any 2 hands: | 60,542,338,200,002 | 0.31748328 | 2 | 0.634967 |
| Win all 3 hands: | 4,349,812,564,164 | 0.02281036 | 9 | 0.205293 |
| Perfect hand: | 1,292,171,414,688 | 0.00677613 | 16 | 0.108418 |
| Fully suited hand: | 63,619,434,648 | 0.00033362 | 36 | 0.012010 |
| Same color perfect hand: | 33,196,006,536 | 0.00017408 | 76 | 0.013230 |
| Same suit perfect hand: | 674,410,968 | 0.00000354 | 2001 | 0.007077 |
| | 190,694,571,947,880 | 1.0000 | | 0.980995 |

TABLE 15

| | |
|---|---|
| Base Game EV | 98.708054% |
| Bonus Game EV | 98.099502% |
| Weighted EV | 98.555916% |

Tables 16 and 17 show the calculations for the base and bonus games when the bonus bet is one-fifteenth the base game bet (bonus bet is one-fifth the amount bet on each hand). Table 18 shows the computation of the weighted combination of 15 units on the base game with one unit on the bonus game based on the results in Tables 16 and 17. The resulting 98.6998% is only slightly better than the 98.6954% when the optimal base game strategy is used with this betting ratio. This is expected because as the percentage of the base game bet gets high (fifteen-to-one in this case), the less often there will be enough of a gain in the bonus return to compensate for moving away from the optimal base game strategy.

TABLE 16

| | Outcome | Combination Counts | Probability | Pay | EV |
|---|---|---|---|---|---|
| 7-combination | Player wins: | 97,702,477,390,346 | 0.5123506 | 2 | 1.024701 |
| | Player pushes: | 7,596,385,527,822 | 0.0398354 | 1 | 0.039835 |
| | Player loses: | 84,069,667,197,520 | 0.4408600 | 0 | 0.000000 |
| | Total: | 189,368,530,115,688 | 0.9930463 | | 1.064537 |
| 14-combination | Player wins: | 75,661,932,802,178 | 0.3967702 | 2 | 0.793540 |
| | Player pushes: | 44,443,434,719,780 | 0.2330608 | 1 | 0.233061 |
| | Player loses: | 69,263,162,593,730 | 0.3632152 | 0 | 0.000000 |
| | Total: | 189,368,530,115,688 | 0.9930463 | | 1.026601 |

TABLE 16-continued

| | Outcome | Combination Counts | Probability | Pay | EV |
|---|---|---|---|---|---|
| 21-combination | Player wins: | 52,115,044,590,807 | 0.2732907 | 2 | 0.546581 |
| | Player pushes: | 46,068,260,301,645 | 0.2415815 | 1 | 0.241581 |
| | Player loses: | 91,185,205,223,236 | 0.4781741 | 0 | 0.000000 |
| | Total: | 189,368,530,115,68 | 0.9930463 | | 0.788163 |
| | Perfect Hand: | 1,326,041,832,192 | 0.0069537 | 12 | 0.083445 |
| | Total: | 190,694,571,947,880 | 1.0000000 | | 0.987582 |

TABLE 17

| | Player Sets of Dealt Cards | Probability | Pay | EV |
|---|---|---|---|---|
| No bonus: | 124,628,578,994,954 | 0.65355074 | 0 | 0 |
| Win any 2 hands: | 60,340,088,521,850 | 0.31642269 | 2 | 0.632845 |
| Win all 3 hands: | 4,336,243,164,236 | 0.02273921 | 9 | 0.204653 |
| Perfect hand: | 1,292,171,414,688 | 0.00677613 | 16 | 0.108418 |
| Fully suited hand: | 63,619,434,648 | 0.00033362 | 36 | 0.012010 |
| Same color perfect hand: | 33,196,006,536 | 0.00017408 | 76 | 0.013230 |
| Same suit perfect hand: | 674,410,968 | 0.00000354 | 2001 | 0.007077 |
| | 190,694,571,947,880 | 1.0000 | | 0.9782334 |

TABLE 18

| | |
|---|---|
| Base Game EV | 98.758188% |
| Bonus Game EV | 97.823341% |
| Weighted EV | 98.699760% |

Figure 5:
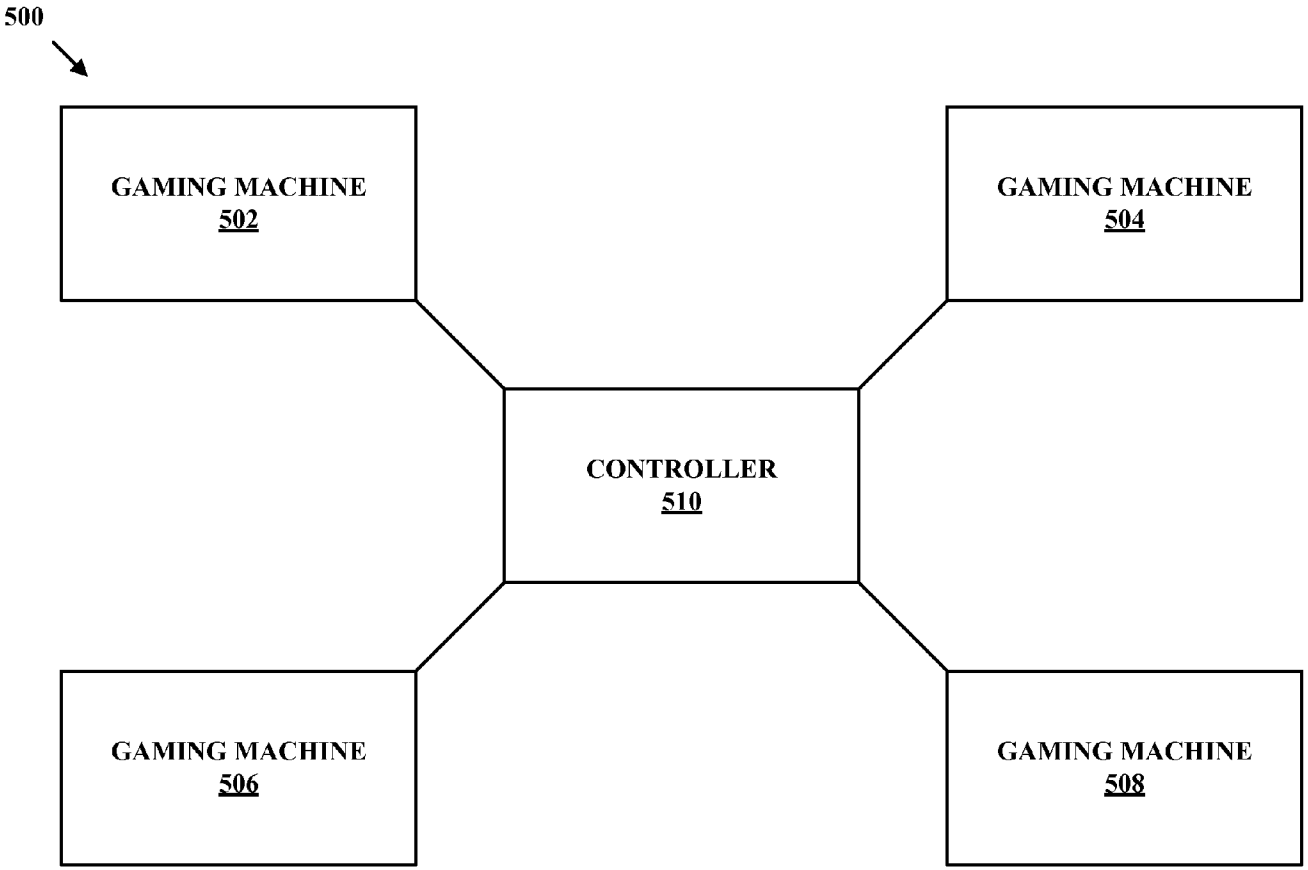
FIG. 5 is a simplified block diagram of a system of linked gaming machines according to the present invention.

FIG. 5 is a simplified block diagram of a system of linked gaming machines, in accordance with exemplary embodiments. As shown, system 500 contains gaming machines 502-508 connected to controller 510 via one or more communication links. One or more entities may be interposed along the communication links, and additional or fewer gaming machines may be present without departing from the scope of the claims.

Gaming machines 502-508 may be any machines capable of carrying out the various gaming-machine functions, and are described in detail with reference to FIG. 6.

Controller 510 may be any device or combination of devices capable of carrying out the controller-functions described herein. As such, controller 510 may receive inputs from the gaming machines 502-508, where those inputs represent (for example) one or more wagers being placed (among other possibilities), and/or one or more combinations being arranged, among other possibilities, and/or may send outputs to gaming machines 502-508 representing (for example) gaming devices (cards, dominoes, etc.) that have been dealt, the combinations of other players, and the payouts received, among others. Moreover, additional controllers may be present in system 500.

Additionally or alternatively, controller 510 may function as one or more players during a game, perhaps by performing the functions of a dealer. Further, controller 110 may take the form of one of gaming machines 502-508. Those having skill in the art will recognize that additional and/or different functions may be performed by controller 510 without departing from the scope of the claims.

Figure 6:
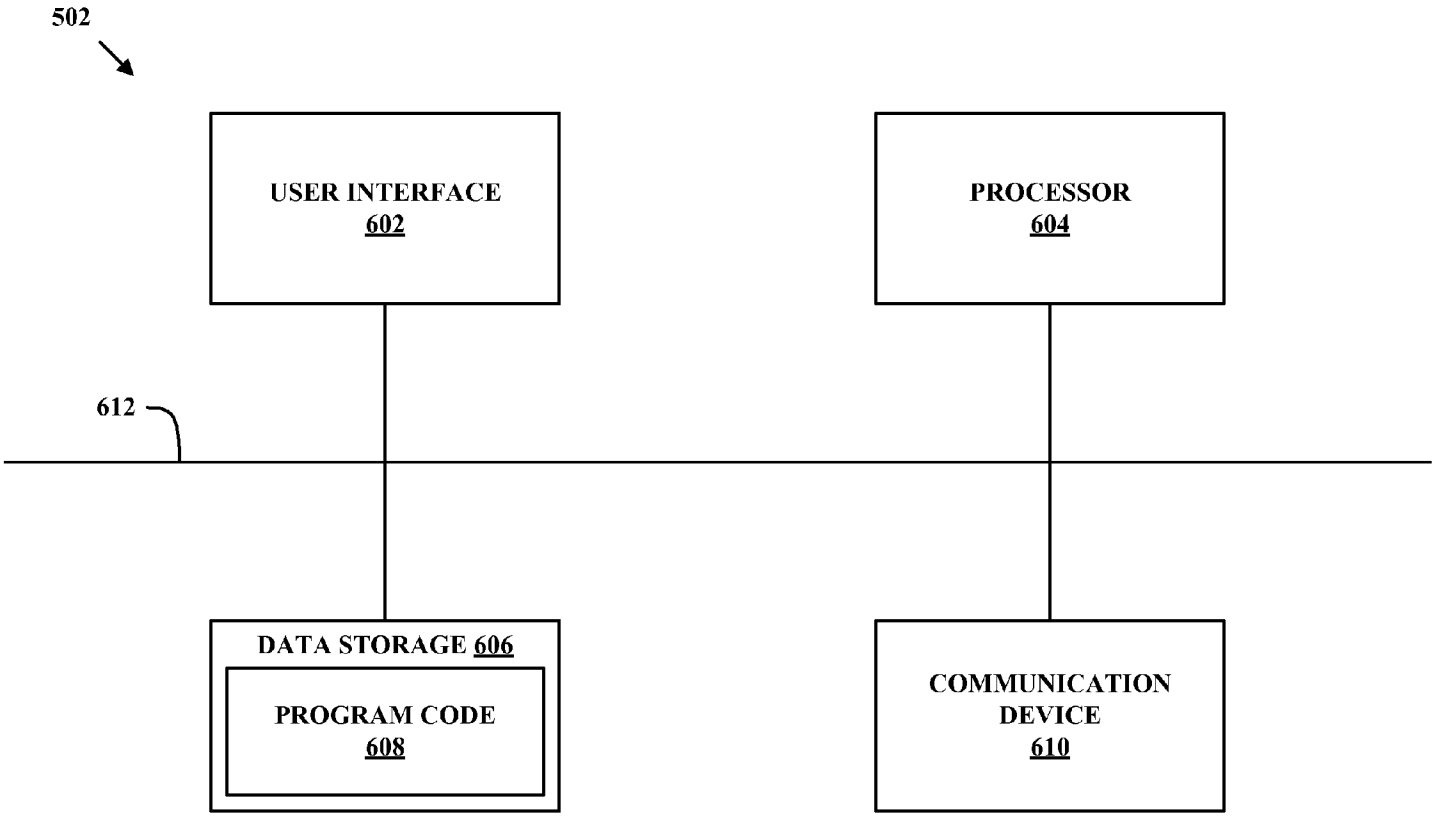
FIG. 6 is a simplified block diagram of a gaming machine according to the present invention.

FIG. 6 is a simplified block diagram of a gaming machine, in accordance with exemplary embodiments. As shown, gaming machine 502 includes a user interface 602, a processor (cpu) 604, a data storage 606 having a game program 608 (perhaps for operating user interface 602, which may include a video display), and a communication device 610 each connected by a bus 612. Gaming machine 600 may take the form of a computer, a personal digital assistant (PDA), a smartphone, a feature phone, a cell phone, a portable video game device, a portable music device, a gaming system, and/or a machine dedicated to the function of performing the various functions described herein, among other examples. Note that gaming machines 504-508 and controller 510 may take form similar to gaming machine 502, and may include any combination of elements contained therein.

User interface 602 may function to facilitate interaction with a user of gaming machine 600. As such, user interface 602 may include a video display, a wagering input mechanism, a card manipulation control device, and/or a payout mechanism, among other possibilities. The video display could comprise a liquid-crystal display (LCD), plasma, and/or cathode-ray tube (CRT) display, for example, and could comprise a touch-screen display, among other possibilities. The wagering input mechanism and/or the payout mechanism could be any device capable of receiving a wager input and/or providing a payout, and could take the form of a video display, a card reader, and/or a coin/bill slot, among other examples. Further, the card manipulation control device could take the form of a touchscreen, a keyboard, a joystick, a button, any combination of these, or other entities. Note that one or more of these entities could also be combined into a single entity.

Processor 604 may be, for example, a general-purpose microprocessor and/or a discrete signal processor. Though processor 604 is described here as a single processor, those having skill in the art will recognize that gaming machine 600 may contain multiple (e.g., parallel) processors.

Data storage 606 may store a set of machine-language game-program instructions 608 that are executable by processor 604 to carry out various game functions described throughout this specification. Alternatively, some or all of the functions could instead be implemented through hardware. In addition, data storage 606 may store various data to facilitate carrying out various functions described herein. In addition, data storage 606 may hold user-interface data, among many other possibilities.

Communication interface 610 may include a chipset suitable for communicating with one or more devices such as, for example, controller 510 and/or gaming machines 504-508. The chipset could be suitable for wired and/or wireless communication over a personal areas network (perhaps via Bluetooth or USB), a local area network (perhaps via Ethernet), and/or a wide area network (perhaps using the Internet). Those having skill in the art will recognize that other configurations for connecting devices may be used as well.

Thus, while the invention has been disclosed and described with respect to certain embodiments, those of skill in the art will recognize modifications, changes, other applications and the like which will nonetheless fall within the spirit and ambit of the invention, and the following claims are intended to capture such variations.

I claim:

1. A gaming apparatus for a wagering card game, comprising:

a video display;

a processor haying a game program, and operating said video display;

said game program using a standard deck of playing cards as a basis for gameplay, with said cards having numeric values based upon indicated numbers thereon, face cards being valued at ten, and aces being valued at one or eleven;

a wagering input for a wager to be placed by a player, and registering said wagering input;

said game program randomly dealing six cards from said deck to the player as a player hand, said player hand being displayed on said video display;

six other cards being randomly dealt to a dealer as a dealer hand from the remainder of said deck at some point in said gameplay;

a card-manipulation control device operable by the player for arranging said player hand in three two-card combinations on said video display, in sums with an objective of equaling or coming below target values of seven, fourteen and twenty-one, if possible, in respective combinations;

said game program arranging said dealer hand in three two-card combinations in sums with the objective of equaling or coming below said target values, if possible, in respective combinations;

said game program further restricting said dealer two-card combinations to first attempting to make twenty-one using the two highest value cards in the dealer hand without exceeding twenty-one; second attempting to make fourteen without exceeding fourteen if possible, and lastly using the remaining two cards in the dealer hand for the seven target value, said dealer two-card combinations being displayed on said video display at some point in said gameplay;

said game program evaluating said player and dealer combinations, with any player combination exceeding its respective target value constituting a bust; any player combination which does not exceed its respective target value and which exceeds said dealer's combination constituting a win; and any player combination which is the same as said dealer's combination and which does not exceed its respective target value constituting a push;

and said game program determining a payout, if any, based upon outcomes of said player and dealer combinations according to a predetermined payout methodology, and a mechanism yielding said payout to the player.

2. The gaming apparatus of claim 1, wherein said game program receives an initial at least minimum wager placed by the player on each of the player's two-card combinations prior to presenting said player hand.

3. The gaming apparatus card game of claim 2, wherein said initial wager may be equal between respective player two-card combinations.

4. The gaming apparatus of claim 1, wherein said game program provides the player with an option to place a second wager option after said game program determines that said player has arranged said player hand.

5. The gaming apparatus of claim 1, wherein said player and dealer hands each have cards in a number to exactly equal the number of cards required for said player and dealer two-card combinations.

6. The gaming apparatus of claim 5, wherein said cards correspond to playing cards of said standard deck, with said cards having numeric values based upon indicated numbers thereon, face cards being valued at ten, and aces being valued at one or eleven;

said game program dealing said six cards to said player as said player hand;

said game program dealing said six other cards to said dealer as said dealer hand;

said game program allowing said player to arrange said player hand in said three two-card combinations, in sums with the objective of equaling or coming below three different target values selected in a range of two and twenty-one, if possible, in respective combinations comprising first, second and third target values;

said game program arranging said dealer hand in said three two-card combinations in sums with the objective of equaling or coming below said three different target values, if possible, in respective combinations.

7. The gaming apparatus of claim 1, wherein said game program determines the payout using a game paytable which provides a greater payout for the player who has two wins as an outcome, and an even greater payout for the player who has three wins as the outcome.

8. The gaming apparatus of claim 7, wherein said game paytable provides the player a further increased payout in the event said player achieves combinations of exactly each said target value.

9. The gaming apparatus card game of claim 7, wherein said game program provides a bonus wager option to the player, with a bonus payout being determined according to a bonus paytable.

10. A gaming apparatus for a wagering card game, comprising:

video display;

a processor having a game program, and operating said video display;

said game program using a standard deck of playing cards as a basis for gameplay, with said cards having numeric values based upon indicated numbers thereon, face cards being valued at ten, and aces being valued at one or eleven;

a wagering input for a wager to be placed by a player, and registering said wagering input;

said game program randomly dealing six cards from said deck to the player as a player hand, said player hand being displayed on said video display;

six other cards being randomly dealt from the remainder of said deck as a dealer hand at some point in said gameplay;

a card-manipulation control device operable by the player for arranging said player hand in three two-card combinations on said video display, in sums with an objective of equaling or coming below differing target values in a range from two to twenty-one, if possible, in respective combinations, comprising first, second and third target values;

said game program arranging said dealer hand in three two-card combinations in sums with the objective of equaling or coming below said target values, if possible, in respective combinations;

said game program further restricting said dealer two-card combinations to first attempting to make said first target value without exceeding said first target value; second attempting to make said second target value without exceeding said second target value, if possible, and lastly using the remaining two cards in the dealer hand for said third target value, said dealer two-card combinations being displayed on said video display at some point in said gameplay;

said game program evaluating said player and dealer combinations, with any player combination exceeding its respective target value constituting a bust; any player combination which does not exceed its respective target value and which exceeds the dealer's combination constituting a win; and any player's combination which is the same as said dealer's combination constituting a non-win;

said game program determining a payout, if any, based upon outcomes of said player and dealer of combinations according to a predetermined payout methodology, and a mechanism providing said payout to the player.

11. The gaming apparatus of claim 10, wherein said game program further restricts said dealer two-card combinations to first attempting to make the first target value from said dealer hand without exceeding that first target value; and then second attempting to make another and different target value from said dealer hand, if possible, and if there are three respective target values, lastly thirdly attempting to make said third target value from said dealer hand, if possible.

12. The gaming apparatus of claim 10, wherein said non-win is a loss or a push.

13. The gaming apparatus of claim 10, wherein said game program receives an initial at least minimum wager placed by the player on each of the two-card combinations prior to presenting said player hand.

14. The gaming apparatus of claim 13, wherein said initial wager may be equal between respective two-card combinations.

15. The gaming apparatus of claim 14, wherein said game program provides the player with an option to place a second wager after said game program determines that said player has arranged said player hand.

16. The gaming apparatus of claim 10, wherein a predetermined number of cards is the same for the dealer and each said player.

17. The gaming apparatus of claim 10, wherein said game program further restricts said dealer two card combinations to using a combination of cards which does not include an ace when attempting to make a fourteen target value, if the dealer hand presents more than one possibility for making a highest-valued fourteen target value which does not exceed fourteen after said twenty-one target value has been determined.

18. The gaming apparatus of claim 10, wherein said target values are seven, fourteen and twenty-one.

19. The gaming apparatus of claim 18, wherein said first target value is twenty-one.

20. The gaming apparatus of claim 19, wherein said second target value is fourteen, and wherein said program further restricts said dealer two card combinations to using a combination of cards which does not include an ace when attempting to make a second arrangement comprising said arrangement having said second target value, if the dealer is presented with more than one possibility for making a highest-valued second arrangement without exceeding said second target value.

21. The gaming apparatus of claim 19, wherein said game program comprises for determining a bonus payout.

22. The gaming apparatus of claim 19, wherein said game program comprises means for determining a bonus payout.

23. The gaming apparatus of claim 10, wherein said game program further awards a the payout if a bonus condition exists, wherein the bonus condition is selected from a group of bonus conditions consisting of winning any two combinations, winning all three combinations, winning a perfect hand, winning a fully-suited hand, winning a same-color perfect hand, and winning a same-suit perfect hand.

* * * * *